US010557222B2

(12) United States Patent
Lin

(10) Patent No.: US 10,557,222 B2
(45) **Date of Patent: *Feb. 11, 2020**

(54) WOVEN TEXTILE

(71) Applicant: Ping-Kun Lin, Changhua County (TW)

(72) Inventor: Ping-Kun Lin, Changhua County (TW)

( * ) Notice: Subject to any disclaimer, the term of this patent is extended or adjusted under 35 U.S.C. 154(b) by 198 days.

This patent is subject to a terminal disclaimer.

(21) Appl. No.: 15/725,621

(22) Filed: Oct. 5, 2017

(65) Prior Publication Data

US 2019/0106815 A1 Apr. 11, 2019

(51) Int. Cl.

| | |
|---|---|
| ***D03D 17/00*** | (2006.01) |
| ***D03D 15/08*** | (2006.01) |
| ***D03D 25/00*** | (2006.01) |

(52) U.S. Cl.

CPC ..... *D03D 17/00* (2013.01); *D03D 15/08* (2013.01); *D03D 25/005* (2013.01); *Y10T 442/3187* (2015.04)

(58) Field of Classification Search

CPC ..... D03D 17/00; D03D 25/005; D03D 15/08; Y10T 442/3187

USPC ..... 442/1–37

See application file for complete search history.

(56) References Cited

U.S. PATENT DOCUMENTS 5,601,907 A * 2/1997 Matsumoto ..... D03D 3/00 428/131

* cited by examiner

*Primary Examiner* — Elizabeth C Imani

(74) *Attorney, Agent, or Firm* — Muncy, Geissler, Olds & Lowe, P.C.

(57) ABSTRACT

A woven textile is provided, including at least two blocks connected with each other. Each of the two blocks has an upper layer and a lower layer which are woven and fixed by a binding thread, and the upper layer and the lower layer are respectively composed of woven braids which extend meanderingly. The textile braid of the upper layer and the textile braid of the lower layer define a plurality of meshes, and the textile braids of the two blocks have different diameters so that the meshes on the two blocks have different dimensions.

10 Claims, 4 Drawing Sheets

WOVEN TEXTILE

BACKGROUND OF THE INVENTION

Field of the Invention

The present invention relates to a woven textile.

Description of the Prior Art

Woven textiles are widely used in various products, for example, clothes, shoe uppers and other daily supplies; however, the characteristics of the woven textile are deeply influenced by weaving ways, materials and designs, and the woven textile needs to be improved according to functions and requirements needed.

Specifically, a common woven textile is woven continuously with single one thread, so it is time-consuming, and once there was a loose thread, the woven textile would be torn apart completely. In addition, a thickness of this type of woven textiles are usually not thick, so if a manufacturer wants to increase the thickness of the woven textile, s/he often needs to thicken woven threads or weave for multiple times. However, if the manufacturer thickens the woven thread, the textile becomes too heavy or has poor air-permeability; and if the manufacturer weaves the woven threads for multiple times, it is labor-consuming and time-consuming and has poor air-permeability.

In addition, two surfaces of a woven textile which is integrally woven are made of the same material, so if the two surfaces of the woven textile cannot have materials, colors and weaving structures, and the function of the woven textile is limited.

Furthermore, when the woven textile is woven in a common weaving way, meshes have limited dimensions. If the manufacturer wants to intentionally make the meshes greater, s/he often needs to use the skill of stitch skipping, so it is difficult to manufacture the woven textile, and a structural strength of the woven textile decreases.

In addition, the common woven textiles are woven in a just one way, and the meshes and stretch elasticity are consistent. If the woven textile is used on places such as shoe uppers, and the manufacturer wants to provide different mesh dimensions and stretch elasticity on different blocks of the shoe upper, s/he needs to stitch different woven fabrics to each other. Thus, the manufacturing process is more complicated.

The present invention has arisen to mitigate and/or obviate the afore-described disadvantages.

SUMMARY OF THE INVENTION

The major object of the present invention is to provide a woven textile, which has preferable elasticity and air-permeability and is three-dimensional, and the woven textile has meshes in different dimensions and elastic blocks to provide preferable functionality.

To achieve the above and other objects, a woven textile is provided, having a first end and a second which is opposite to the first end, a connection of the first end and the second end define a longitudinal direction, the woven textile includes a first block and a second block which are connected with each other, the first and second blocks are arranged along the longitudinal direction, and the woven textile further includes at least one binding thread; the first block includes a first upper layer and a first lower layer, the first upper layer includes at least one first woven braid, the first woven braid is woven by a plurality of woven threads and meanderingly extends to form a plurality of hollow-out portions, the first lower layer includes at least one second woven braid, the second woven braid is woven by a plurality of woven threads and meanderingly extends to form a plurality of hollow-out portions, and a overlapping part of the hollow-out portions of the first upper layer and the hollow-out portions of the first lower layer forms a plurality of first meshes; the second block includes a second upper layer and a second lower layer, the second upper layer includes at least one third woven braid, the third woven braid is woven by a plurality of woven threads and meanderingly extends to form a plurality of hollow-out portions, the second lower layer includes at least one fourth woven braid, the fourth woven braid is woven by a plurality of woven threads and meanderingly extends to form a plurality of hollow-out portions, and a overlapping part of the hollow-out portions of the second upper layer and the hollow-out portions of the second lower layer forms a plurality of second meshes; the at least one binding thread weaves and fixes the first woven braid and the second woven braid with each other and weaves and fixes the third woven braid and the fourth woven braid with each other, and the at least one binding thread weaves and fixes the first block and the second block with each other; at least the first woven braid is greater than the third woven braid in diameter, and each said first mesh is smaller than each said second mesh in area.

The woven textile of the present invention has the upper layer and the lower layer which are independent structures, and the two layers are bound by the binding thread; therefore, the woven textile can be thicker and more elastic. In addition, since the woven braid of the upper layer and lower layer are not woven with each other, there are gaps between the textile braid of the upper and lower layers which are good for air-permeability and buffering. With the mesh in different dimensions and elastic block, the functionality of the woven textile is more preferable.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
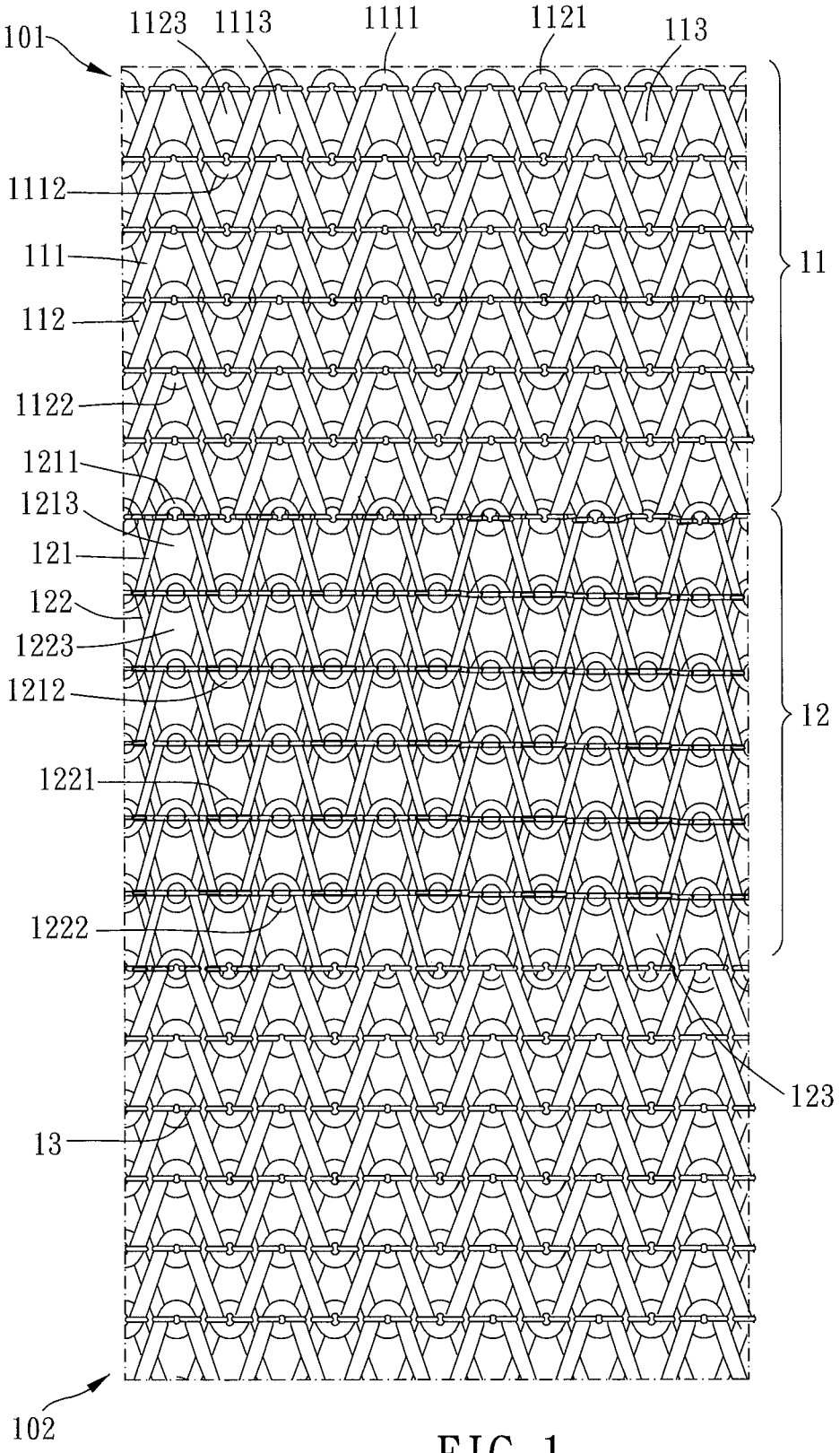
FIG. 1 is a plan view of a first embodiment the present invention.
Figure 2:
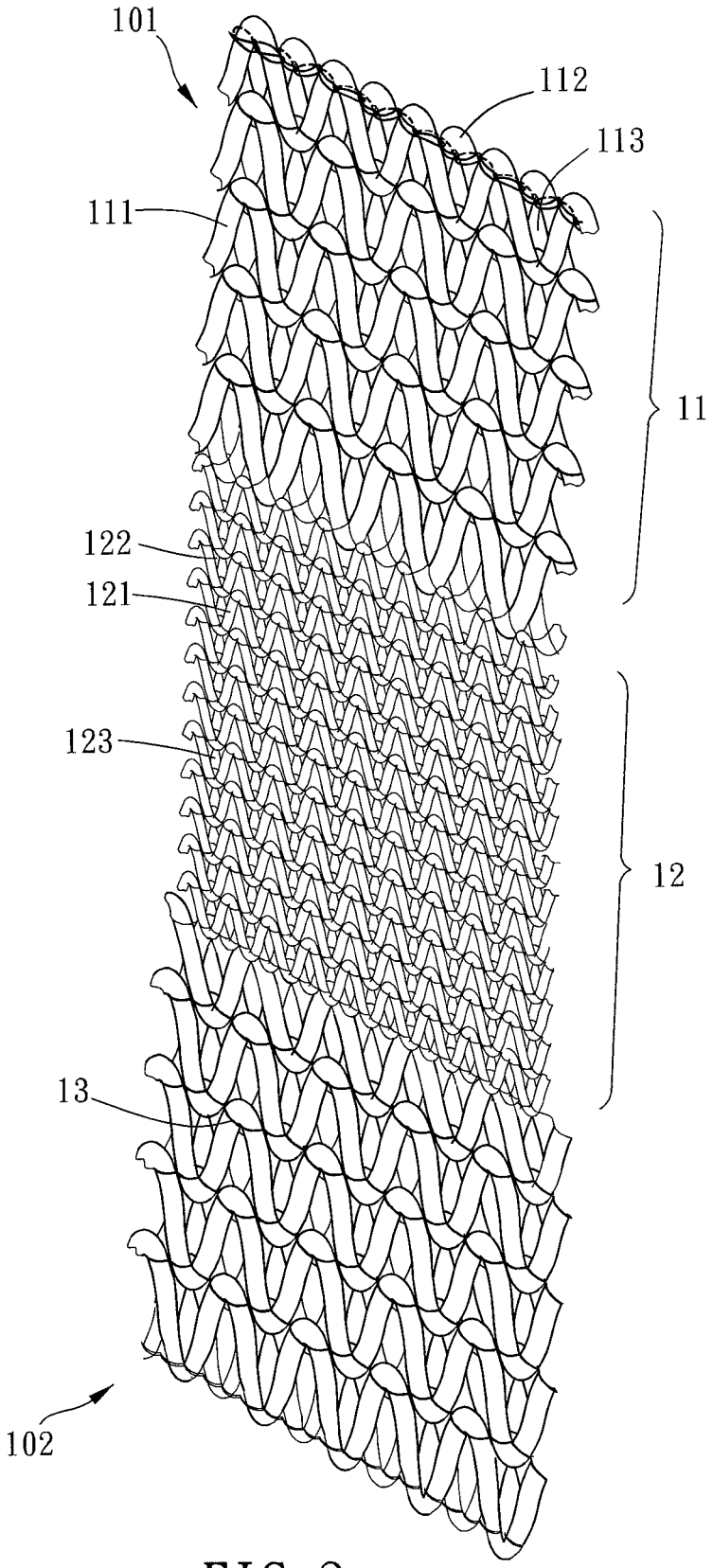
FIG. 2 is a stereogram of a second embodiment of the present invention.
Figure 3:
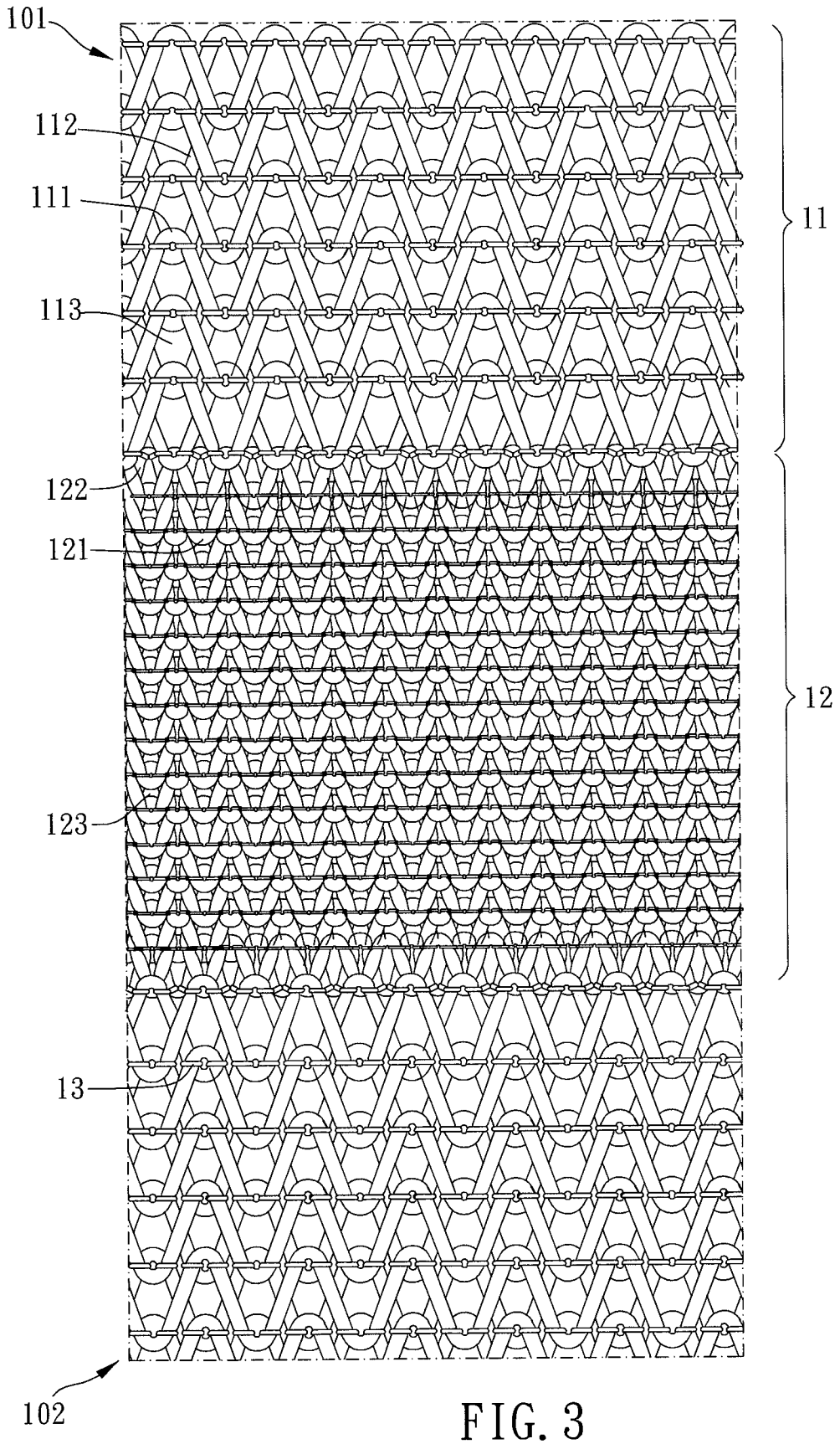
FIG. 3 is a plan view of the second embodiment the present invention.
Figure 4:
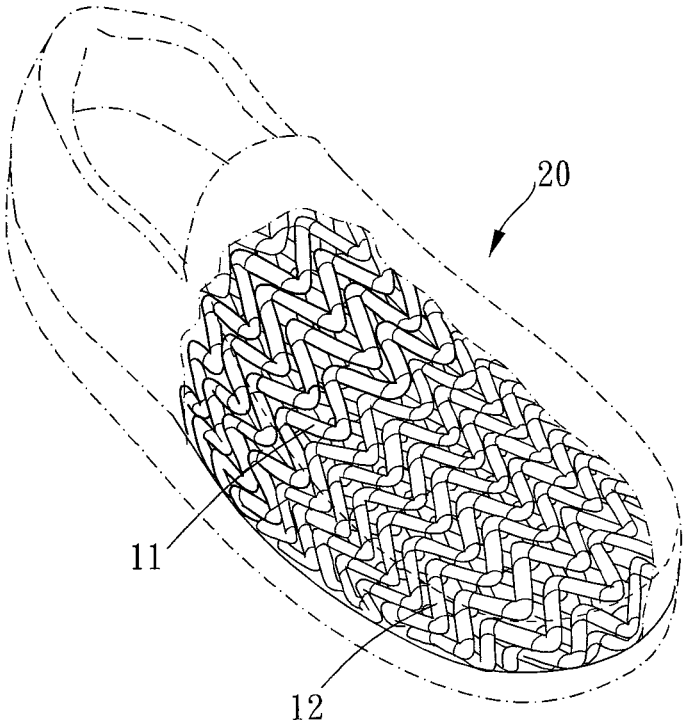
FIG. 4 is a drawing showing the present invention in use.

Please refer to FIGS. 1 to 4 for a woven textile. The woven textile has a first end 101 and a second 102 which is opposite to the first end 101, a connection of the first end 101 and the second end 102 define a longitudinal direction, the woven textile includes a first block 11 and a second block 12 which are connected with each other, the first and second blocks 11, 12 are arranged along the longitudinal direction, and the woven textile further includes at least one binding thread 13; the first block 11 includes a first upper layer and a first lower layer, the first upper layer includes at least one first woven braid 111, the first woven braid 111 is woven by a plurality of woven threads and meanderingly extends to form a plurality of hollow-out portions 1113, the first lower layer includes at least one second woven braid 112, the second woven braid 112 is woven by a plurality of woven threads and meanderingly extends to form a plurality of hollow-out portions 1123, and a overlapping part of the hollow-out portions 1113 of the first upper layer and the hollow-out portions 1123 of the first lower layer forms a plurality of first meshes 113, in other words, each said first mesh 113 is defined by a part of the first woven braid 111 and a part of the second woven braid 112; the second block 12 includes a second upper layer and a second lower layer, the second upper layer includes at least one third woven braid 121, the third woven braid 121 is woven by a plurality of woven threads and meanderingly extends to form a plurality of hollow-out portions 1213, the second lower layer includes at least one fourth woven braid 122, the fourth woven braid 122 is woven by a plurality of woven threads and meanderingly extends to form a plurality of hollow-out portions 1223, and a overlapping part of the hollow-out portions 1213 of the second upper layer and the hollow-out portions 1223 of the second lower layer forms a plurality of second meshes 123, in other words, each said second mesh 123 is defined by a part of the third woven braid 121 and a part of the fourth woven braid 122; the at least one binding thread 13 weaves and fixes the first woven braid 111 and the second woven braid 112 with each other and weaves and fixes the third woven braid 121 and the fourth woven braid 122 with each other, and the at least one binding thread 13 weaves and fixes the first block 11 and the second block 12 with each other; at least the first woven braid 111 is greater than the third woven braid 121 in diameter, each said first mesh 113 is smaller than each said second mesh 123 in area, and preferably, at least the second woven braid 112 is greater than the fourth woven braid 122 in diameter.

Specifically, the first upper layer includes the plurality of first woven braids 111, the first woven braids 111 are sequentially arranged along the longitudinal direction, the first lower layer includes the plurality of second woven braids 112, the second woven braids 112 are sequentially arranged along the longitudinal direction, the second upper layer includes the plurality of third woven braids 121, the third woven braids 121 are sequentially arranged along the longitudinal direction, the second lower layer includes the plurality of fourth woven braids 122, the fourth woven braids 122 are sequentially arranged along the longitudinal direction and include the plurality of binding threads 13, and the binding threads 13 respectively weave and fix the least one of the first woven braids 111 and at least one of the second woven braids 112 with each other, weave and fix the least one of the third woven braids 121 and at least one of the fourth woven braids 122 with each other, and weave and fix the first block 11 and the second block 12 with each other. Moreover, each said first woven braid 111 extends in waves and has a plurality of first wave crests 1111 and a plurality of first wave troughs 1112 which are interlacedly arranged, the first waves crests 1111 are closer to the first end 101, the first wave troughs 1112 are closer to the second end 102, each said second woven braid 112 extends in waves and has a plurality of second wave crests 1121 and a plurality of second first wave troughs 1122 which are interlacedly arranged, the second waves crests 1121 are closer to the first end 101, the second wave troughs 1122 are closer to the second end 102, each said third woven braid 121 extends in waves and has a plurality of third wave crests 1211 and a plurality of third wave troughs 1212 which are interlacedly arranged, the third waves crests 1211 are closer to the first end 101, the third wave troughs 1212 are closer to the second end 102, each said fourth woven braid 122 extends in waves and has a plurality of fourth wave crests 1221 and a plurality of fourth wave troughs 1222 which are interlacedly arranged, the fourth waves crests 1221 are closer to the first end 101, and the fourth wave troughs 1222 are closer to the second end 102.

More specifically, the first wave crests 1111 of the first woven braids 111 correspond to one another in position, the second wave crests 1121 of the second woven braids 112 correspond to one another in position, the third wave crests 1211 of the third woven braids 121 correspond to one another in position, the fourth wave crests 1221 of the fourth woven braids 122 correspond to one another in position, the first wave crests 1111 of the first woven braids 111 correspond to the third wave crests 1211 of the third woven braids 121 in position, and the second wave crests 1211 of the second woven braids 112 correspond to the fourth wave crests 1221 of the fourth woven braids 122 in position; each said first wave crest 1111 of each said first woven braid 111 is located between two of the second wave crests 1121 neighboring to each other of one of the second woven braids 112 so that the first woven braids 111 and the second woven braids 112 are interlaced and complementary to each other, and each said third wave crest 1211 of each said third woven braid 121 is located between two of the fourth wave crests 1221 neighboring to each other of one of the fourth woven braids 122 so that the third woven braids 121 and the fourth woven braids 122 are interlaced and complementary to each other; each said first wave crest 1111 of each said first woven braid 111 is located between two of the first wave troughs 1112 neighboring to each other of the first woven braids 111 neighboring to each other, each said first wave trough 1112 of each said first woven braid 111 is located between two of the first wave crests 1111 neighboring to each other of the first woven braids 111 neighboring to each other, each said second wave crest 1121 of each said second woven braid 112 is located between two of the second wave troughs 1122 neighboring to each other of the second woven braids 112 neighboring to each other, each said second wave trough 1122 of each said second woven braid 112 is located between two of the second wave crests 1121 neighboring to each other of the second woven braids 112 neighboring to each other, the binding thread 13 is simultaneously woven on the first wave crest 1111 and the first wave trough 1112 neighboring to each other of two of the first woven braids 111 neighboring to each other as well as on the second wave crest 1121 and the second wave trough 1122 neighboring to each other of two of the second woven braids 112 neighboring to each other, each said third wave crest 1211 of each said third woven braid 121 is located between two of the third wave troughs 1212 neighboring to each other of the third woven braids 121 neighboring to each other, each said third wave trough 1212 of each said third woven braid 121 is located between two of the third wave crests 1211 neighboring to each other of the third woven braids 121 neighboring to each other, each said fourth wave crest 1221 of each said fourth woven braid 122 is located between two of the fourth wave troughs 1222 neighboring to each other of the fourth woven braids 122 neighboring to each other, each said fourth wave trough 1222 of each said fourth woven braid 122 is located between two of the fourth wave crests 1221 neighboring to each other of the fourth woven braids 122 neighboring to each other, and the binding thread 13 is simultaneously woven on the third wave crest 1211 and the third wave trough 1212 neighboring to each other of two of the third woven braids 121 neighboring to each other as well as on the fourth wave crest 1221 and the fourth wave trough 1222 neighboring to each other of two of the fourth woven braids 122 neighboring to each other. That is, the first upper layer and the first lower layer are woven to each other in a complementary shape, and the second upper layer and the second lower layer are also woven to each other in a complementary shape. In addition, the first woven braid 111 and the third woven braid 121 are correspondingly arranged in shape, and the second woven braid 112 and the fourth woven braid 122 are also correspondingly arranged in shape to make the appearance more organized and provide better elasticity for different blocks.

More specifically, each said first woven braid 111, each said second woven braid 112, each said third woven braid 121 and each said fourth woven braid 122 are woven by a braiding machine. Preferably, each said first woven braid 111 (or each said second woven braid 112, each said third woven braid 121 and each said fourth woven braid 122) includes an outer layer and a mandrel, the outer layer is woven by a plurality of woven threads to form a tubular shape, and the mandrel is disposed in the outer layer.

In practice, the first woven braids 111 (or the second woven braids 112, the third woven braids 121 and the fourth woven braids 122) may also be a woven braid which is continuously woven.

In other embodiments, the first upper layer and the first lower layer have at least one first middle layer therebetween, the second upper layer and the second lower layer have at least one second middle layer therebetween, and the first and second middle layers are respectively made of woven braids and have a plurality of hollow-out portions.

Given the above, the woven textile is composed of two layers and has relatively broader mesh, and the woven textile has greater air-permeability, elasticity and thickness. With blocks having meshes in different dimensions, the same woven textile has blocks in different elasticity, and when the woven textile is used in an article such as a shoe upper 20, the manufacturer can use the part with broader meshes on appropriate blocks (for example, near a shoe opening) to provide greater stretch elasticity and use the part with narrower meshes on other blocks to provide greater structural strength, so the woven textile has a preferable functionality.

While we have shown and described various embodiments in accordance with the present invention, it should be clear to those skilled in the art that further embodiments may be made without departing from the scope of the present invention.

What is claimed is:

1. A woven textile, having a first end and a second which is opposite to the first end, a direction from the first end to the second end defining a longitudinal direction, a horizontal direction being defined perpendicular to the longitudinal direction, the woven textile including a first block and a second block which are connected with each other, the first and second blocks being arranged along the longitudinal direction, the woven textile further including at least one binding thread;

wherein the first block includes a first upper layer and a first lower layer, the first upper layer includes at least one first woven braid, the first woven braid is woven by a plurality of woven threads and meanderingly extends along the horizontal direction, the meandering first woven braid extending back and forth along the longitudinal direction to form a plurality of first threads to form a plurality of hollow-out portions among adjacent first threads of the first woven braid, the first lower layer includes at least one second woven braid, the second woven braid is woven by a plurality of woven threads and meanderingly extends along the horizontal direction, the meandering second woven braid extending back and forth along the longitudinal direction to form a plurality of second threads to form a plurality of hollow-out portions among the second woven braid, and a overlapping part of the hollow-out portions of the first upper layer and the hollow-out portions of the first lower layer forms a plurality of first meshes;

wherein the second block includes a second upper layer and a second lower layer, the second upper layer includes at least one third woven braid, the third woven braid is woven by a plurality of woven threads and meanderingly extends along the horizontal direction, the meandering third woven braid extending back and forth along the longitudinal direction to form a plurality of third threads to form a plurality of hollow-out portions among the third woven braid, the second lower layer includes at least one fourth woven braid, the fourth woven braid is woven by a plurality of woven threads and meanderingly extends along the horizontal direction, the meandering fourth woven braid extending back and forth along the longitudinal direction to form a plurality of fourth threads to form a plurality of hollow-out portions among the fourth braid, and a overlapping part of the hollow-out portions of the second upper layer and the hollow-out portions of the second lower layer forms a plurality of second meshes;

wherein the at least one binding thread weaves and fixes the first woven braid and the second woven braid with each other and weaves and fixes the third woven braid and the fourth woven braid with each other, and the at least one binding thread weaves and fixes the first block and the second block with each other;

wherein at least the first woven braid is greater than the third woven braid in diameter, and each said first mesh is smaller than each said second mesh in area.

2. The woven textile of claim 1, wherein the first upper layer includes the plurality of first woven braids, the first woven braids are sequentially arranged along the longitudinal direction, the first lower layer includes the plurality of second woven braids, the second woven braids are sequentially arranged along the longitudinal direction, the second upper layer includes the plurality of third woven braids, the third woven braids are sequentially arranged along the longitudinal direction, the second lower layer includes the plurality of fourth woven braids, the fourth woven braids are sequentially arranged along the longitudinal direction and include the plurality of binding threads, and the binding threads respectively weave and fix the least one of the first woven braids and at least one of the second woven braids with each other, weave and fix the least one of the third woven braids and at least one of the fourth woven braids with each other, and weave and fix the first block and the second block with each other.

3. The woven textile of claim 1, wherein each said first woven braid extends in waves and has a plurality of first wave crests and a plurality of first wave troughs which are interlacedly arranged, the first waves crests are closer to the first end, the first wave troughs are closer to the second end, each said second woven braid extends in waves and has a plurality of second wave crests and a plurality of second first wave troughs which are interlacedly arranged, the second waves crests are closer to the first end, the second wave troughs are closer to the second end, each said third woven braid extends in waves and has a plurality of third wave crests and a plurality of third wave troughs which are interlacedly arranged, the third waves crests are closer to the first end, the third wave troughs are closer to the second end, each said fourth woven braid extends in waves and has a plurality of fourth wave crests and a plurality of fourth wave troughs which are interlacedly arranged, the fourth waves crests are closer to the first end, and the fourth wave troughs are closer to the second end.

4. The woven textile of claim 3, wherein the first wave crests of the first woven braids correspond to one another in position, the second wave crests of the second woven braids correspond to one another in position, the third wave crests of the third woven braids correspond to one another in position, the fourth wave crests of the fourth woven braids correspond to one another in position, the first wave crests of the first woven braids correspond to the third wave crests of the third woven braids in position, and the second wave crests of the second woven braids correspond to the fourth wave crests of the fourth woven braids in position.

5. The woven textile of claim 4, wherein each said first wave crest of each said first woven braid is located between two of the second wave crests neighboring to each other of one of the second woven braids so that the first woven braids and the second woven braids are interlaced and complementary to each other, and each said third wave crest of each said third woven braid is located between two of the fourth wave crests neighboring to each other of one of the fourth woven braids so that the third woven braids and the fourth woven braids are interlaced and complementary to each other.

6. The woven textile of claim 5, wherein each said first wave crest of each said first woven braid is located between two of the first wave troughs neighboring to each other of the first woven braids neighboring to each other, each said first wave trough of each said first woven braid is located between two of the first wave crests neighboring to each other of the first woven braids neighboring to each other, each said second wave crest of each said second woven braid is located between two of the second wave troughs neighboring to each other of the second woven braids neighboring to each other, each said second wave trough of each said second woven braid is located between two of the second wave crests neighboring to each other of the second woven braids neighboring to each other, the binding thread is simultaneously woven on the first wave crest and the first wave trough neighboring to each other of two of the first woven braids neighboring to each other as well as on the second wave crest and the second wave trough neighboring to each other of two of the second woven braids neighboring to each other, each said third wave crest of each said third woven braid is located between two of the third wave troughs neighboring to each other of the third woven braids neighboring to each other, each said third wave trough of each said third woven braid is located between two of the third wave crests neighboring to each other of the third woven braids neighboring to each other, each said fourth wave crest of each said fourth woven braid is located between two of the fourth wave troughs neighboring to each other of the fourth woven braids neighboring to each other, each said fourth wave trough of each said fourth woven braid is located between two of the fourth wave crests neighboring to each other of the fourth woven braids neighboring to each other, and the binding thread is simultaneously woven on the third wave crest and the third wave trough neighboring to each other of two of the third woven braids neighboring to each other as well as on the fourth wave crest and the fourth wave trough neighboring to each other of two of the fourth woven braids neighboring to each other.

7. The woven textile of claim 2, wherein each said first woven braid, each said second woven braid, each said third woven braid and each said fourth woven braid are woven by a braiding machine.

8. The woven textile of claim 1, wherein each said first mesh is defined by a part of the first woven braid and a part of the second woven braid, and each said second mesh is defined by a part of the third woven braid and a part of the fourth woven braid.

9. The woven textile of claim 1, wherein the second woven braid is greater than the fourth woven braid in diameter.

10. The woven textile of claim 1, wherein the first upper layer and the first lower layer have at least one first middle layer therebetween, the second upper layer and the second lower layer have at least one second middle layer therebetween, and the first and second middle layers are respectively made of woven braids and have a plurality of hollow-out portions.

* * * * *